US010590963B2

(12) United States Patent
Kondo et al.

(10) Patent No.: US 10,590,963 B2
(45) Date of Patent: Mar. 17, 2020

(54) HYDRAULIC EXCAVATOR DRIVE SYSTEM

(71) Applicant: KAWASAKI JUKOGYO KABUSHIKI KAISHA, Kobe-shi, Hyogo (JP)

(72) Inventors: Akihiro Kondo, Kobe (JP); Hideyasu Muraoka, Akashi (JP); Kazuto Fujiyama, Kobe (JP)

(73) Assignee: KAWASAKI JUKOGYO KABUSHIKI KAISHA, Kobe-shi (JP)

( * ) Notice: Subject to any disclaimer, the term of this patent is extended or adjusted under 35 U.S.C. 154(b) by 0 days.

(21) Appl. No.: 16/343,725

(22) PCT Filed: Sep. 29, 2017

(86) PCT No.: PCT/JP2017/035549
§ 371 (c)(1),
(2) Date: Apr. 19, 2019

(87) PCT Pub. No.: WO2018/079194
PCT Pub. Date: May 3, 2018

(65) Prior Publication Data

US 2019/0271333 A1 Sep. 5, 2019

(30) Foreign Application Priority Data

Oct. 27, 2016 (JP) ..... 2016-210667

(51) Int. Cl.
*F15B 13/044* (2006.01)
*F15B 11/10* (2006.01)
(Continued)

(52) U.S. Cl.
CPC ..... *F15B 11/10* (2013.01); *E02F 3/425* (2013.01); *E02F 9/2004* (2013.01); *E02F 9/22* (2013.01);
(Continued)

(58) Field of Classification Search
CPC ..... F15B 13/0442; F15B 2211/40592; F15B 2211/46; F15B 2211/6654
See application file for complete search history.

(56) References Cited

U.S. PATENT DOCUMENTS 7,127,887 B2 * 10/2006 Nakamura ..... E02F 9/2228 60/421
2012/0198831 A1 8/2012 Kodaka et al.
2017/0107694 A1 4/2017 Kondo et al.

FOREIGN PATENT DOCUMENTS

JP 2011-085198 A 4/2011
JP 2015-183756 A 10/2015
JP 2016-109272 A 6/2016

* cited by examiner

*Primary Examiner* — F Daniel Lopez
(74) *Attorney, Agent, or Firm* — Oliff PLC

(57) ABSTRACT

A hydraulic excavator drive system includes: first and second pumps; arm cylinder; arm first control valve connected to the cylinder by an arm crowding supply line and arm pushing supply line; arm second control valve connected to the supply lines by a first and second replenishment line; and arm operation device that outputs an operation signal corresponding to an inclination angle of an operating lever. The arm second control valve is configured so, when performing an arm crowding operation, an opening area at a meter-in side changes in accordance with the operation signal, and an opening area at a meter-out side is: kept to zero when a predetermined condition is not satisfied; and kept to zero until the operation signal becomes a setting value or greater, and when the operation signal has become the setting value or greater, increases to a maximum value when the predetermined condition is satisfied.

8 Claims, 4 Drawing Sheets

(51) Int. Cl.

| | |
|---|---|
| ***E02F 3/42*** | (2006.01) |
| ***E02F 9/20*** | (2006.01) |
| ***E02F 9/22*** | (2006.01) |
| ***F15B 13/043*** | (2006.01) |
| ***F15B 11/044*** | (2006.01) |
| ***F15B 11/02*** | (2006.01) |

(52) U.S. Cl.

CPC ..... *E02F 9/2203* (2013.01); *E02F 9/2225* (2013.01); *E02F 9/2285* (2013.01); *E02F 9/2292* (2013.01); *F15B 11/02* (2013.01); *F15B 11/044* (2013.01); *F15B 13/043* (2013.01); *F15B 13/0442* (2013.01); *E02F 9/2296* (2013.01); *F15B 2211/20523* (2013.01); *F15B 2211/20576* (2013.01); *F15B 2211/40592* (2013.01); *F15B 2211/428* (2013.01); *F15B 2211/633* (2013.01); *F15B 2211/6309* (2013.01); *F15B 2211/6313* (2013.01); *F15B 2211/6346* (2013.01); *F15B 2211/6355* (2013.01); *F15B 2211/6654* (2013.01); *F15B 2211/7053* (2013.01)

HYDRAULIC EXCAVATOR DRIVE SYSTEM

TECHNICAL FIELD

The present invention relates to a hydraulic excavator drive system.

BACKGROUND ART

Generally speaking, a hydraulic excavator includes: a boom that is raised and lowered relative to a turning unit; an arm swingably coupled to the distal end of the boom; and a bucket swingably coupled to the distal end of the arm. A drive system installed in such a hydraulic excavator includes, for example, a boom cylinder that drives the boom, an arm cylinder that drives the arm, and a bucket cylinder that drives the bucket. These hydraulic actuators are supplied with hydraulic oil from pumps via control valves.

For example, Patent Literature 1 discloses a hydraulic excavator drive system in which an arm first control valve and an arm second control valve are used as control valves for an arm cylinder. The arm cylinder is supplied with hydraulic oil from a first pump via the arm first control valve and also from a second pump via the arm second control valve. The hydraulic drive system disclosed in Patent Literature 1 adopts a configuration for switching, in accordance with a load pressure, a route through which the hydraulic oil returns to a tank at the time of performing an arm crowding operation.

Specifically, in the hydraulic excavator drive system disclosed in Patent Literature 1, a relief line is connected to an arm pushing supply line that connects the arm first control valve and the arm cylinder, and the relief line is provided with an adjustment valve. The adjustment valve blocks the relief line when the load pressure at the time of performing an arm crowding operation is low, and opens the relief line when the load pressure at the time of performing an arm crowding operation is high. Accordingly, by setting the opening area at the meter-out side of each of the arm first control valve and the arm second control valve to a small value, an occurrence of cavitation at the head side of the arm cylinder is prevented. Since the relief line is opened when the load pressure is high, the discharge pressures of the pumps will not become higher than necessary, and thus motive power consumption by the pumps is reduced.

CITATION LIST

Patent Literature

PTL 1: Japanese Laid-Open Patent Application Publication No. 2015-183756

SUMMARY OF INVENTION

Technical Problem

The hydraulic drive system disclosed in Patent Literature 1 requires the adjustment valve in addition to the arm first control valve and the arm second control valve. This results in cost increase.

In view of the above, an object of the present invention is to provide a hydraulic excavator drive system capable of, with an inexpensive configuration, preventing the occurrence of cavitation at the head side of an arm cylinder and reducing the motive power consumption by pumps.

Solution to Problem

In order to solve the above-described problems, a hydraulic excavator drive system according to the present invention includes: a first pump; a second pump; an arm cylinder; an arm first control valve connected to the first pump and a tank, and connected to the arm cylinder by an arm crowding supply line and an arm pushing supply line; an arm second control valve connected to the second pump and the tank, connected to the arm crowding supply line by a first replenishment line, and connected to the arm pushing supply line by a second replenishment line; and an arm operation device including an operating lever that receives an arm crowding operation and an arm pushing operation, the arm operation device outputting an operation signal corresponding to an inclination angle of the operating lever. The arm second control valve is configured such that, at a time of performing the arm crowding operation, an opening area at a meter-in side, which is the first replenishment line side, of the arm second control valve changes in accordance with the operation signal, and an opening area at a meter-out side, which is the second replenishment line side, of the arm second control valve is: kept to zero in a case where a predetermined condition is not satisfied; and kept to zero until the operation signal becomes a setting value or greater, and when the operation signal has become the setting value or greater, increases to a maximum value in a case where the predetermined condition is satisfied.

According to the above configuration, in the case where the predetermined condition is not satisfied at the time of performing the arm crowding operation, the opening area at the meter-out side of the arm second control valve is kept to zero. Therefore, by setting the opening area at the meter-out side of the arm first control valve to a small value, the occurrence of cavitation at the head side of the arm cylinder can be prevented in the case where the predetermined condition is not satisfied at the time of performing the arm crowding operation. On the other hand, in the case where the predetermined condition is satisfied at the time of performing the arm crowding operation, the opening area at the meter-out side of the arm second control valve increases to the maximum value when the operating lever is inclined greatly. Accordingly, at the time, large part of the hydraulic oil discharged from the arm cylinder smoothly returns to the tank through the arm second control valve. Therefore, the discharge pressures of the pumps will not become higher than necessary, and thus the motive power consumption by the pumps can be reduced. In addition, when the hydraulic excavator performs excavation, the reduced motive power consumption in the arm crowding operation can be utilized as driving force, including for the operation of other actuators. As a result, increase in excavating force is also achieved.

For example, the arm second control valve may include a first pilot port for the arm crowding operation and a second pilot port for the arm pushing operation. The hydraulic excavator drive system may further include: a solenoid proportional valve connected to the first pilot port; and a controller that feeds, to the solenoid proportional valve, a command current corresponding to the operation signal outputted from the arm operation device. In the case where the predetermined condition is not satisfied, the controller may limit the command current to a constant value when the operation signal has become the setting value or greater, and in the case where the predetermined condition is satisfied, the controller may refrain from limiting the command current regardless of whether or not the operation signal has become the setting value or greater.

The predetermined condition may be a condition that a pressure of the arm crowding supply line is higher than a threshold. According to this configuration, although the arm crowding supply line (in some cases, the first replenishment line) needs to be provided with a pressure sensor, the opening area at the meter-out side of the arm second control valve can be switched to zero or to the maximum value based on a load pressure at the time of performing the arm crowding operation.

The hydraulic excavator drive system may further include an engine that drives the first pump and the second pump. The predetermined condition may be a condition that a rotational speed of the engine is higher than a threshold. When the rotational speed of the engine is relatively high, the discharge flow rates of the pumps are also high, and cavitation at the head side of the arm cylinder is less likely to occur in the arm crowding operation. Therefore, by setting the opening area at the meter-out side of the arm second control valve to the maximum value when the rotational speed of the engine is higher than the threshold as in the above-described configuration, the motive power consumption by the pumps can be reduced while preventing the occurrence of cavitation.

The predetermined condition may be a condition that at least one of a discharge pressure of the first pump and a discharge pressure of the second pump is higher than a threshold. Generally speaking, the hydraulic excavator drive system is provided with a pressure sensor detecting the discharge pressure of the first pump and a pressure sensor detecting the discharge pressure of the second pump. Therefore, by adopting the above configuration in which the discharge pressure of the first pump and/or the discharge pressure of the second pump is/are compared with the threshold, it becomes unnecessary to additionally incorporate the pressure sensor that detects the pressure of the arm crowding supply line.

Advantageous Effects of Invention

According to the present invention, the occurrence of cavitation at the head side of an arm cylinder can be prevented and the motive power consumption by pumps can be reduced with an inexpensive configuration.

DESCRIPTION OF EMBODIMENTS

Figure 1:
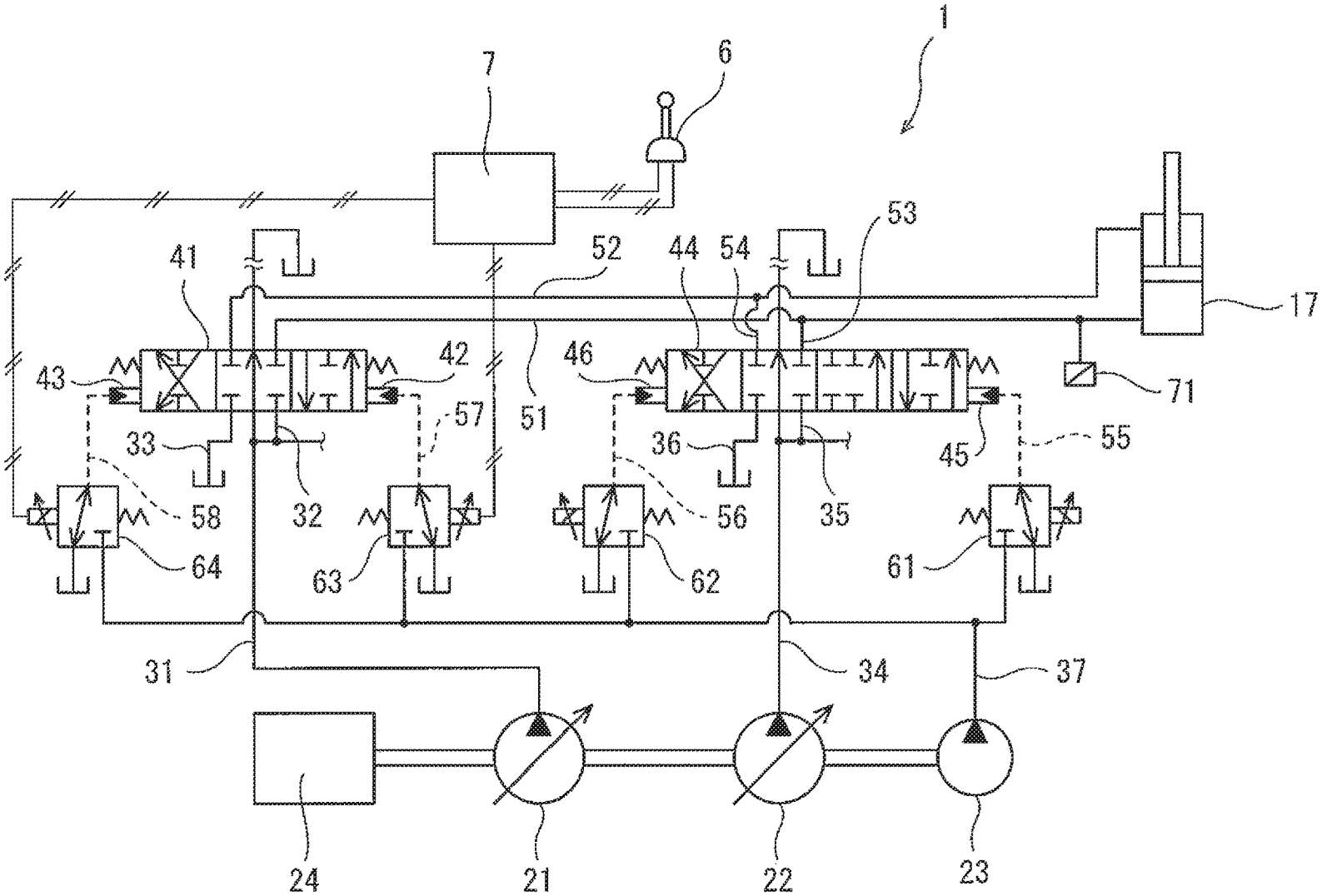
FIG. 1 shows a schematic configuration of a hydraulic excavator drive system according to one embodiment of the present invention.
Figure 2:
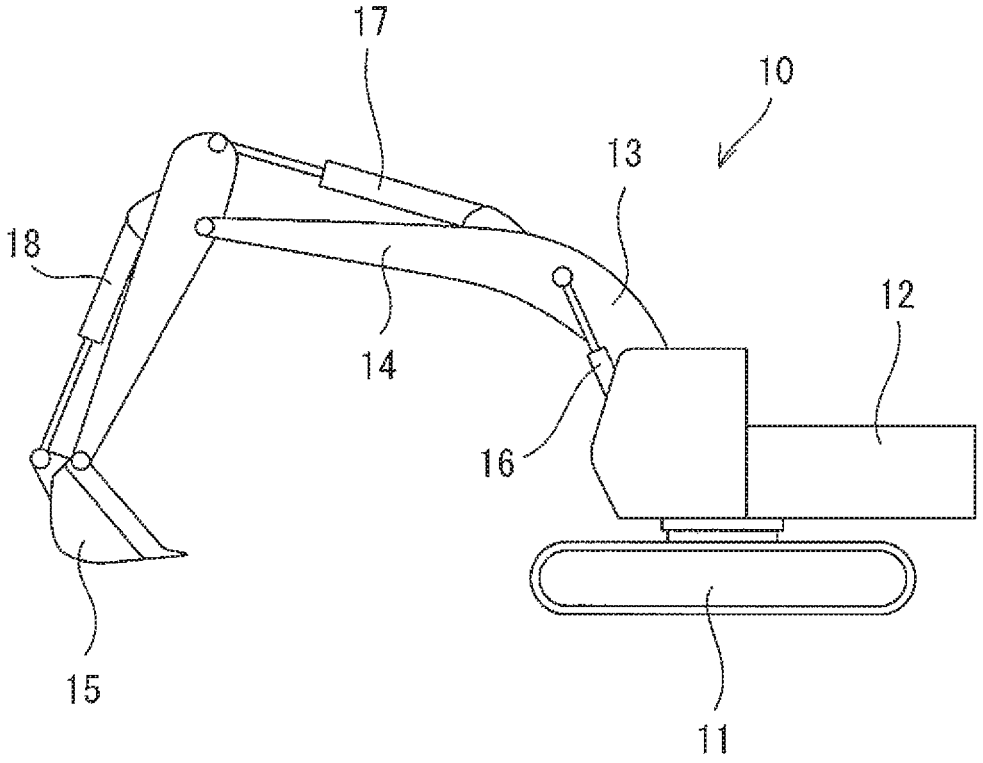
FIG. 2 is a side view of a hydraulic excavator.

FIG. 1 shows a hydraulic excavator drive system 1 according to one embodiment of the present invention. FIG. 2 shows a hydraulic excavator 10, in which the drive system 1 is installed.

The hydraulic excavator 10 shown in FIG. 2 includes a running unit 11 and a turning unit 12. The hydraulic excavator 10 further includes: a boom 13, which is raised and lowered relative to the turning unit 12; an arm 14 swingably coupled to the distal end of the boom 13; and a bucket 15 swingably coupled to the distal end of the arm 14. However, the hydraulic excavator 10 need not include the running unit 11. In such a case, for example, the hydraulic excavator 10 may be installed on a ship, or the hydraulic excavator 10 may be installed at a port as a loader or an unloader.

The drive system 1 includes, as hydraulic actuators, a pair of right and left running motors and a turning motor (which are not shown), a boom cylinder 16, an arm cylinder 17, and a bucket cylinder 18. The boom cylinder 16 drives the boom 13. The arm cylinder 17 drives the arm 14. The bucket cylinder 18 drives the bucket 15. In the present embodiment, arm pushing is performed by contraction of the arm cylinder 17. However, as an alternative, arm pushing may be performed by expansion of the arm cylinder 17.

As shown in FIG. 1, the drive system 1 further includes a first main pump 21 and a second main pump 22, which supply hydraulic oil to the above hydraulic actuators. The first main pump 21 and the second main pump 22 are driven by an engine 24. The engine 24 also drives an auxiliary pump 23.

The first main pump 21 and the second main pump 22 are variable displacement pumps. The discharge flow rate of the first main pump 21 and the discharge flow rate of the second main pump 22 may be controlled by hydraulic negative control or by electrical positive control. Alternatively, the discharge flow rate of the first main pump 21 and the discharge flow rate of the second main pump 22 may be controlled by load-sensing control.

The arm cylinder 17 is supplied with the hydraulic oil from the first main pump 21 via an arm first control valve 41 and from the second main pump 22 via an arm second control valve 44. It should be noted that the illustration of control valves for other hydraulic actuators is omitted in FIG. 1.

Specifically, a first center bleed line 31 extends from the first main pump 21 to a tank, and a second center bleed line 34 extends from the second main pump 22 to the tank. The arm first control valve 41 is disposed on the first center bleed line 31, and the arm second control valve 44 is disposed on the second center bleed line 34. Although not illustrated as mentioned above, for example, a control valve for the turning motor is disposed on the first center bleed line 31, and a control valve for the bucket cylinder 18 is disposed on the second center bleed line 34.

Each control valve on the first center bleed line 31 is connected to the first main pump 21 by a pump line 32, and each control valve on the second center bleed line 34 is connected to the second main pump 22 by a pump line 35. That is, the control valves on the first center bleed line 31 are connected to the first main pump 21 in parallel, and the control valves on the second center bleed line 34 are connected to the second main pump 22 in parallel. Each control valve on the first center bleed line 31 is connected to the tank by a tank line 33, and each control valve on the second center bleed line 34 is connected to the tank by a tank line 36.

The arm first control valve 41 is connected to the arm cylinder 17 by an arm crowding supply line 51 and an arm pushing supply line 52. The arm second control valve 44 is connected to the arm crowding supply line 51 by a first replenishment line 53 and to the arm pushing supply line 52 by a second replenishment line 54.

The arm first control valve 41 and the arm second control valve 44 are operated by an arm operation device 6. The arm operation device 6 includes an operating lever that receives an arm crowding operation and an arm pushing operation, and outputs an operation signal corresponding to an inclination angle of the operating lever.

In the present embodiment, the arm operation device 6 is an electrical joystick that outputs, as the operation signal, an electrical signal corresponding to the inclination angle of the operating lever. The electrical signal outputted from the arm operation device 6 is inputted to a controller 7. For example, the controller 7 is a computer including a CPU and memories such as a ROM and RAM. The CPU executes a program stored in the ROM.

The arm second control valve 44 includes a first pilot port 45 for arm crowding operation and a second pilot port 46 for arm pushing operation. The first pilot port 45 is connected to a first solenoid proportional valve 61 by an arm crowding pilot line 55, and the second pilot port 46 is connected to a second solenoid proportional valve 62 by an arm pushing pilot line 56.

Similarly, the arm first control valve 41 includes a first pilot port 42 for arm crowding operation and a second pilot port 43 for arm pushing operation. The first pilot port 42 is connected to a third solenoid proportional valve 63 by an arm crowding pilot line 57, and the second pilot port 43 is connected to a fourth solenoid proportional valve 64 by an arm pushing pilot line 58.

At the time of performing an arm pushing operation, the arm first control valve 41 brings the arm pushing supply line 52 into communication with the pump line 32, and brings the arm crowding supply line 51 into communication with the tank line 33. That is, at the time of performing an arm pushing operation, the arm pushing supply line 52 side is the meter-in side, and the arm crowding supply line 51 side is the meter-out side.

Meanwhile, at the time of performing an arm pushing operation, the arm second control valve 44 brings the second replenishment line 54 into communication with the pump line 35, and brings the first replenishment line 53 into communication with the tank line 36. That is, at the time of performing an arm pushing operation, the second replenishment line 54 side is the meter-in side, and the first replenishment line 53 side is the meter-out side.

At the time of performing an arm crowding operation, the arm first control valve 41 brings the arm crowding supply line 51 into communication with the pump line 32, and brings the arm pushing supply line 52 into communication with the tank line 33. That is, at the time of performing an arm crowding operation, the arm crowding supply line 51 side is the meter-in side, and the arm pushing supply line 52 side is the meter-out side.

Figure 3A:
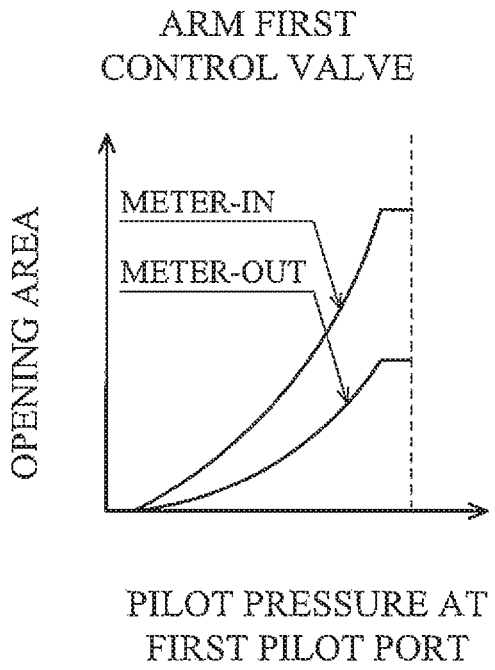
FIG. 3A is a graph showing a relationship between a pilot pressure at a first pilot port and an opening area of an arm first control valve.

To be more specific, as shown in FIG. 3A, the arm first control valve 41 is configured such that, at the time of performing an arm crowding operation, the opening area at the meter-in side of the arm first control valve 41, and the opening area at the meter-out side of the arm first control valve 41, increase in accordance with increase in a pilot pressure led into the first pilot port 42 or the second pilot port 43. In the present embodiment, the opening area at the meter-out side is less than the opening area at the meter-in side.

Meanwhile, at the time of performing an arm crowding operation, the position of the arm second control valve 44 is switched to either a first position or a second position by a pilot pressure led into the first pilot port 45. When the arm second control valve 44 is in the first position, the first replenishment line 53 communicates with the pump line 35, whereas the second replenishment line 54 is blocked. When the arm second control valve 44 is in the second position, the first replenishment line 53 communicates with the pump line 35, whereas the second replenishment line 54 communicates with the tank line 36. At the time of performing an arm crowding operation, the first replenishment line 53 side is the meter-in side, and the second replenishment line 54 side is the meter-out side.

Figure 3B:
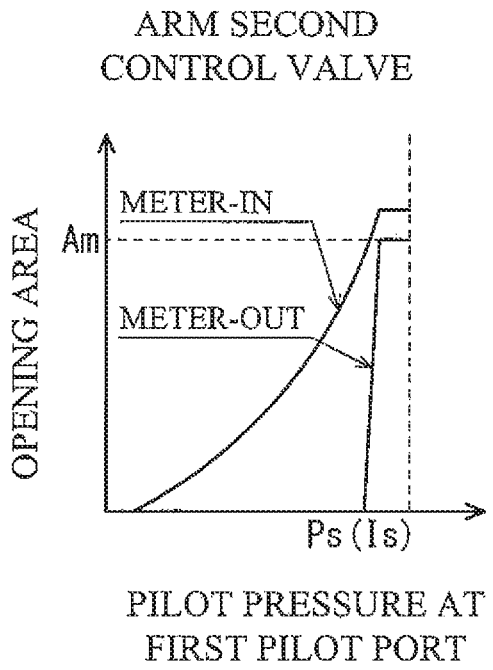
FIG. 3B is a graph showing a relationship between a pilot pressure at a first pilot port and an opening area of an arm second control valve.

To be more specific, as shown in FIG. 3B, the arm second control valve 44 is configured such that, at the time of performing an arm crowding operation, the opening area at the meter-in side of the arm second control valve 44 increases in accordance with increase in a pilot pressure led into the first pilot port 45, whereas the opening area at the meter-out side of the arm second control valve 44 is kept to zero when the pilot pressure is a setting pressure Ps or less, and when the pilot pressure is greater than the setting pressure Ps, the opening area at the meter-out side of the arm second control valve 44 increases to a maximum value Am.

In the present embodiment, at the time of performing an arm crowding operation, the maximum value Am of the opening area at the meter-out side of the arm second control valve 44 is greater than the maximum value of the opening area at the meter-out side of the arm first control valve 41. However, as an alternative, the maximum value Am of the opening area at the meter-out side of the arm second control valve 44 may be less than the maximum value of the opening area at the meter-out side of the arm first control valve 41.

The first to fourth solenoid proportional valves 61 to 64 are connected to the auxiliary pump 23 by a primary pressure line 37. The first to fourth solenoid proportional valves 61 to 64 are controlled by the controller 7. At the time of performing an arm crowding operation, the controller 7 feeds, to the first solenoid proportional valve 61 and the third solenoid proportional valve 63, a command current corresponding to an electrical signal (operation signal) outputted from the arm operation device 6. At the time of performing an arm pushing operation, the controller 7 feeds, to the second solenoid proportional valve 62 and the fourth solenoid proportional valve 64, a command current corresponding to an electrical signal outputted from the arm operation device 6.

In the present embodiment, each of the first to fourth solenoid proportional valves 61 to 64 is a direct proportional valve (normally closed valve) that outputs a secondary pressure that increases in accordance with increase in the command current. The secondary pressure outputted from each of the solenoid proportional valves is led, as the aforementioned pilot pressure, into a corresponding one of the pilot ports (45, 46, 42, and 43) through a respective one of the pilot lines (55 to 58). However, as an alternative, each of the first to fourth solenoid proportional valves 61 to 64 may be an inverse proportional valve (normally open valve) that outputs a secondary pressure that decreases in accordance with increase in the command current.

Figure 4A:
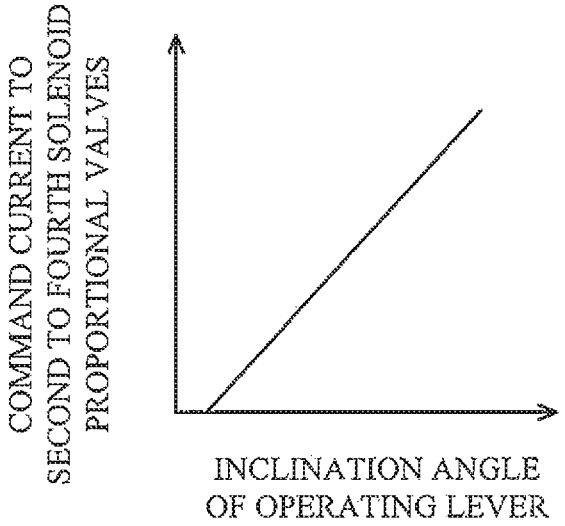
FIG. 4A is a graph showing a relationship between an inclination angle of an operating lever of an arm operation device (i.e., an operation signal outputted from the arm operation device) and a command current fed to second to fourth solenoid proportional valves.

For the second to fourth solenoid proportional valves 62 to 64, as shown in FIG. 4A, the controller 7 increases a command current fed to each of the second to fourth solenoid proportional valves 62 to 64 in accordance with increase in an electrical signal outputted from the arm operation device 6 over the entire range of the electrical signal. For the first solenoid proportional valve 61, at the time of performing an arm pushing operation, similar to FIG. 4A, the controller 7 increases a command current fed to the first solenoid proportional valve 61 in accordance with increase in an electrical signal outputted from the arm operation device 6 over the entire range of the electrical signal.

Figure 4B:
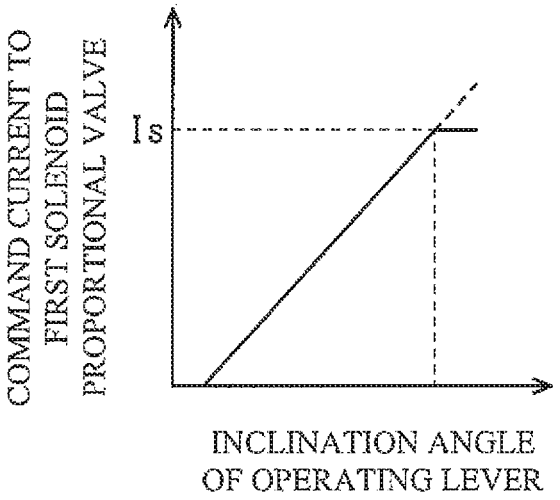
FIG. 4B is a graph showing a relationship between the inclination angle of the operating lever of the arm operation device and a command current fed to a first solenoid proportional valve.

Meanwhile, at the time of performing an arm crowding operation, the controller 7 determines whether or not a predetermined condition is satisfied. In a case where the predetermined condition is not satisfied, as indicated by solid line in FIG. 4B, the controller 7 limits the command current fed to the first solenoid proportional valve 61 to a constant value Is when the electrical signal (operation signal) outputted from the arm operation device 6 has become a setting value or greater. On the other hand, in a case where the predetermined condition is satisfied, as indicated by dashed line in FIG. 4B, the controller 7 refrains from limiting the command current fed to the first solenoid proportional valve 61 regardless of whether or not the electrical signal has become the setting value or greater. That is, in the case where the predetermined condition is satisfied, over the entire range of the electrical signal outputted from the arm operation device 6, the command current fed to the first solenoid proportional valve 61 increases in accordance with increase in the electrical signal. The constant value Is is a value at which the secondary pressure outputted from the first solenoid proportional valve 61 becomes the aforementioned setting pressure Ps.

That is, regarding the arm second control valve 44, at the time of performing an arm crowding operation, the opening area at the meter-in side of the arm second control valve 44 changes in accordance with the electrical signal (operation signal) outputted from the arm operation device 6; meanwhile, looking at the opening area at the meter-out side of the arm second control valve 44, in the case where the predetermined condition is not satisfied, the opening area at the meter-out side is kept to zero, and in the case where the predetermined condition is satisfied, the opening area at the meter-out side is kept to zero when the electrical signal is the setting value or less, and when the electrical signal is greater than the setting value, the opening area at the meter-out side increases to the maximum value Am.

In the present embodiment, the predetermined condition is a condition that the pressure of the arm crowding supply line 51 is higher than a threshold. Therefore, the arm crowding supply line 51 is provided with a pressure sensor 71, which detects the pressure of the arm crowding supply line 51. The controller 7 compares the pressure detected by the pressure sensor 71 with the threshold, and performs the above-described control. It should be noted that, alternatively, the pressure sensor 71 detecting the pressure of the arm crowding supply line 51 may be provided on the first replenishment line 53.

As described above, in the drive system 1 of the present embodiment, in the case where the predetermined condition is not satisfied at the time of performing an arm crowding operation, the opening area at the meter-out side of the arm second control valve 44 is kept to zero. Therefore, by setting the opening area at the meter-out side of the arm first control valve 41 to a small value, the occurrence of cavitation at the head side of the arm cylinder 17 can be prevented in the case where the predetermined condition is not satisfied at the time of performing an arm crowding operation. On the other hand, in the case where the predetermined condition is satisfied at the time of performing an arm crowding operation, the opening area at the meter-out side of the arm second control valve 44 increases to the maximum value Am when the operating lever is inclined greatly. Accordingly, at the time, large part of the hydraulic oil discharged from the arm cylinder 17 smoothly returns to the tank through the arm second control valve 44. Therefore, the discharge pressure of the first main pump 21 and the discharge pressure of the second main pump 22 will not become higher than necessary, and thus the motive power consumption by the first main pump 21 and the second main pump 22 can be reduced. In addition, when the hydraulic excavator performs excavation, the reduced motive power consumption in the arm crowding operation can be utilized as driving force, including for the operation of other actuators. As a result, increase in excavating force is also achieved.

Further, in the present embodiment, the aforementioned predetermined condition is a condition that the pressure of the arm crowding supply line 51 is higher than the threshold. For this reason, although the arm crowding supply line 51 (in some cases, the first replenishment line 53) needs to be provided with a pressure sensor, the opening area at the meter-out side of the arm second control valve 44 can be switched to zero or to the maximum value Am based on a load pressure at the time of performing an arm crowding operation.

(Variations)

The present invention is not limited to the above-described embodiment. Various modifications can be made without departing from the spirit of the present invention.

As one example, the predetermined condition based on which the opening area at the meter-out side of the arm second control valve 44 is switched to zero or to the maximum value Am at the time of performing an arm crowding operation may be a condition that at least one of the discharge pressure of the first main pump 21 and the discharge pressure of the second main pump 22 is higher than a threshold. Generally speaking, the hydraulic excavator drive system is provided with a pressure sensor detecting the discharge pressure of the first main pump 21 and a pressure sensor detecting the discharge pressure of the second main pump 22 (the illustration of these pressure sensors is omitted in FIG. 1). Therefore, by adopting a configuration in which the discharge pressure of the first main pump 21 and/or the discharge pressure of the second main pump 22 is/are compared with the threshold, it becomes unnecessary to additionally incorporate the pressure sensor that detects the pressure of the arm crowding supply line 51.

As another example, the predetermined condition may be a condition that the rotational speed of the engine 24 is higher than a threshold. When the rotational speed of the engine 24 is relatively high, the discharge flow rate of the first main pump 21 and the discharge flow rate of the second main pump 22 are also high, and cavitation at the head side of the arm cylinder 17 is less likely to occur in an arm crowding operation. Therefore, by setting the opening area at the meter-out side of the arm second control valve 44 to the maximum value Am when the rotational speed of the engine 24 is higher than the threshold, the motive power consumption by the first main pump 21 and the second main pump 22 can be reduced while preventing the occurrence of cavitation.

The arm operation device 6 may be a pilot operation valve that outputs, as an operation signal, a pilot pressure corresponding to the inclination angle of the operating lever. In this case, the second to fourth solenoid proportional valves 62 to 64 may be eliminated; the second pilot port 46 of the arm second control valve 44 may be connected to the arm operation device 6 by a pilot line; and the first and second pilot ports 42 and 43 of the arm first control valve 41 may be connected to the arm operation device 6 by the pilot lines 57 and 58. Further, in the case where the arm operation device 6 is a pilot operation valve, a pressure sensor that detects the pilot pressure outputted from the arm operation device 6 at the time of performing an arm crowding operation is provided on the pilot line 57, and the detected pilot pressure is inputted to the controller 7.

Figure 5:
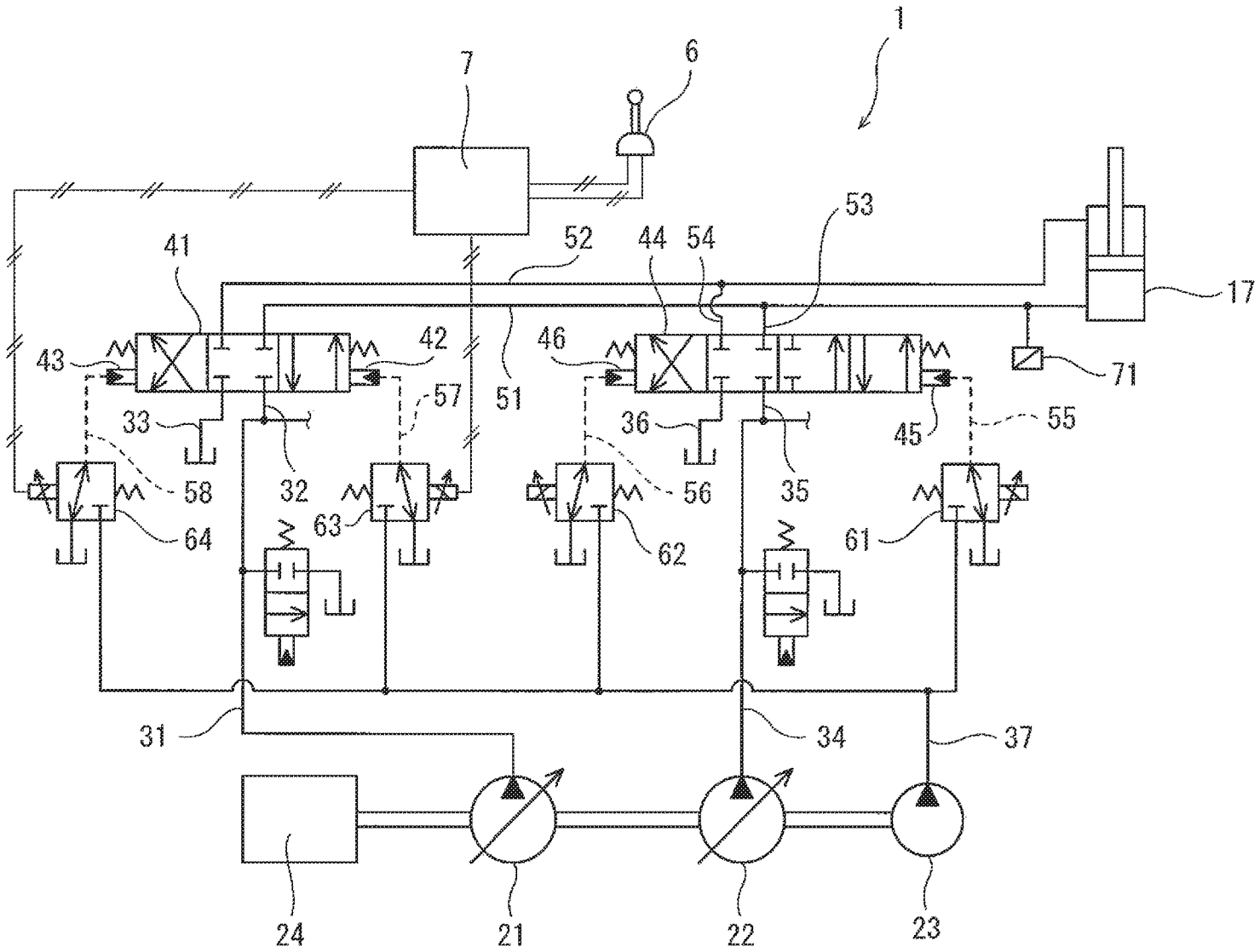
FIG. 5 shows a schematic configuration of the hydraulic excavator drive system according to one variation.

As shown in FIG. 5, the first center bleed line 31 and the second center bleed line 34 may be eliminated.

REFERENCE SIGNS LIST

1 hydraulic excavator drive system
10 hydraulic excavator
17 arm cylinder
21 first main pump
22 second main pump
24 engine
41 arm first control valve
44 arm second control valve
45 first pilot port
46 second pilot port
51 arm crowding supply line
52 arm pushing supply line
53 first replenishment line
54 second replenishment line
arm operation device
61 to 64 solenoid proportional valve
7 controller

The invention claimed is:

1. A hydraulic excavator drive system comprising:
a first pump;
a second pump;
an arm cylinder;
an arm first control valve connected to the first pump and a tank, and connected to the arm cylinder by an arm crowding supply line and an arm pushing supply line;
an arm second control valve connected to the second pump and the tank, connected to the arm crowding supply line by a first replenishment line, and connected to the arm pushing supply line by a second replenishment line; and
an arm operation device including an operating lever that receives an arm crowding operation and an arm pushing operation, the arm operation device outputting an operation signal corresponding to an inclination angle of the operating lever, wherein
the arm second control valve is configured such that, at a time of performing the arm crowding operation,
an opening area at a meter-in side, which is the first replenishment line side, of the arm second control valve changes in accordance with the operation signal, and
an opening area at a meter-out side, which is the second replenishment line side, of the arm second control valve is:
kept to zero in a case where a predetermined condition is not satisfied; and
kept to zero when the operation signal is a setting value or less, and when the operation signal is mater than the setting value, increases to a maximum value in a case where the predetermined condition is satisfied.

2. The hydraulic excavator drive system according to claim 1, wherein
the arm second control valve includes a first pilot port for the arm crowding operation and a second pilot port for the arm pushing operation,
the hydraulic excavator drive system further comprises:
a solenoid proportional valve connected to the first pilot port; and
a controller that feeds, to the solenoid proportional valve, a command current corresponding to the operation signal outputted from the arm operation device, and
in the case where the predetermined condition is not satisfied, the controller limits the command current to a constant value when the operation signal has become the setting value or greater, and in the case where the predetermined condition is satisfied, the controller refrains from limiting the command current regardless of whether or not the operation signal has become the setting value or greater.

3. The hydraulic excavator drive system according to claim 1, wherein
the predetermined condition is a condition that a pressure of the arm crowding supply line is higher than a threshold.

4. The hydraulic excavator drive system according to claim 1, further comprising an engine that drives the first pump and the second pump, wherein
the predetermined condition is a condition that a rotational speed of the engine is higher than a threshold.

5. The hydraulic excavator drive system according to claim 1, wherein
the predetermined condition is a condition that at least one of a discharge pressure of the first pump and a discharge pressure of the second pump is higher than a threshold.

6. The hydraulic excavator drive system according to claim 2, wherein
the predetermined condition is a condition that a pressure of the arm crowding supply line is higher than a threshold.

7. The hydraulic excavator drive system according to claim 2, further comprising an engine that drives the first pump and the second pump, wherein
the predetermined condition is a condition that a rotational speed of the engine is higher than a threshold.

8. The hydraulic excavator drive system according to claim 2, wherein
the predetermined condition is a condition that at least one of a discharge pressure of the first pump and a discharge pressure of the second pump is higher than a threshold.

* * * * *